US006921302B1

(12) United States Patent
Swantner et al.

(10) Patent No.: US 6,921,302 B1
(45) Date of Patent: Jul. 26, 2005

(54) OVERMOLDED SNAP CONNECTOR

(75) Inventors: Michael J. Swantner, Warren, PA (US); Douglas G. Seymour, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/823,360

(22) Filed: Apr. 13, 2004

(51) Int. Cl.[7] ..... H01R 13/11
(52) U.S. Cl. ..... 439/855; 439/606; 439/582; 439/388; 439/522
(58) Field of Search ..... 439/855–856, 439/606, 388, 522, 726, 202

(56) References Cited

U.S. PATENT DOCUMENTS 2,487,521 A * 11/1949 Buckley ..... 439/732
6,361,383 B1 * 3/2002 Ko ..... 439/856

* cited by examiner

*Primary Examiner*—Truc Nguyen
(74) *Attorney, Agent, or Firm*—William H. McNeill

(57) ABSTRACT

A substantially annular electrical contact (12) has an inside dimension (14) and an outside dimension (16). A preferred material for the contact (12) is phosphorus-bronze. The inside dimension (14) is provided with a plurality of contact beams (18). The outside dimension (16) is provided with a plurality of retention beams (20). The contact beams and the retention beams are spaced alternately from one another. A wire-receiving trough (21) is provided between two of the retention beams and extends away from the annulus. A substantially cup-shaped electrically insulating insert (22) (see FIG. 3) is also provided and comprises an interior wall (26) and an exterior wall (28). A preferred material for the insert is polypropylene. The interior wall (26) is provided with pockets (30) for receiving the contact beams (18) and the exterior wall (28) is provided with pockets (32) for receiving the retention beams (20). One end of the pockets (32) is provided with an undercut (32*a*) to receive a reentrant portion (20*a*) formed on the retention beams (20). The space between the pockets (30) includes ribs (31), which limit the deflection of the contact beams (18). The contact (12) and the insert (22) are mated to form a subassembly (24). The contact beams (18) are fitted into the pockets (30) and the retention beams (20) are accommodated within the pockets (32) with the reentrant portions (20*a*) engaged with the undercuts (32*a*) for a secure attachment. The subassembly (24) is then placed in a mold and overmolded with a suitable electrically insulating material to produce a body (34) completely covering the external wall (28) of the insert (22) and forming the electrical connector (10).

2 Claims, 6 Drawing Sheets

OVERMOLDED SNAP CONNECTOR

TECHNICAL FIELD

This invention relates to electrical connectors and more particularly to female connectors formed to mate with a male contact affixed to a glass base.

BACKGROUND ART

Female electrical connectors for attachment to a male contact affixed to a glass base are known and are used in the automobile industry, where the glass base can be a windshield or rear window, for example. In the past the female contact has comprised the ubiquitous female terminal employed with 9-volt dry cell batteries.

The terminal was attached, as by riveting, to a flat brass disc, which included a lead extension for crimping attachment to a wire. This assembly was then overmolded to form an ergonomic cover over the terminal or terminals.

These female electrical connectors often rattled or came loose because of the over-stressing of the contact beams. They were quite flimsy and subject to inefficient electrical connection and, since the connection often takes place under the headliner of the vehicle, caused severe replacement conditions.

DISCLOSURE OF INVENTION

It is, therefore, an object of the invention to obviate the disadvantages of the prior art.

It is another object of the invention to enhance electrical connectors.

These objects are accomplished, in one aspect of the invention, by the provision of a process for making an electrical connector that includes an electrical contact, an electrically insulating insert and an electrically insulating overmolded body, by the steps comprising forming an electrical contact, forming an electrically insulating insert, attaching a wire to the electrical contact, mating the electrical contact and the electrically insulating insert to form a subassembly, and overmolding the subassembly with an electrically insulating material to form an overmolded body thereabout and form the electrical connector.

In another aspect of the invention there is provided an electrical connector that comprises a substantially annular electrical contact with an inside dimension and an outside dimension. The inside dimension is provided with a plurality of contact beams depending therefrom and the outside dimension is provided with a plurality of retention beams depending therefrom. The plurality of contact beams and the plurality of retention beams are spaced alternately from one another. A substantially cup-shaped electrically insulating insert is mated with the annular electrical contact to form a subassembly. The substantially cup-shaped insulator has an interior wall and an exterior wall, and the interior wall includes a plurality of pockets for receiving the contact beams. The exterior wall includes a plurality of pockets for receiving the retention beams, and the contact beams and the retention beams engage their respective pockets. An electrically insulating overmold forms a body about the subassembly, with the body completely covering the exterior wall of the cup-shaped electrically insulating insert.

The use of the electrically insulating insert, with the particular pockets formed for the reception of the contact beams, leaves a plurality of ribs between the pockets and these ribs limit the amount of deflection of the contact beams, thus providing an over-stress feature absent in the prior connectors and greatly improving the connector.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
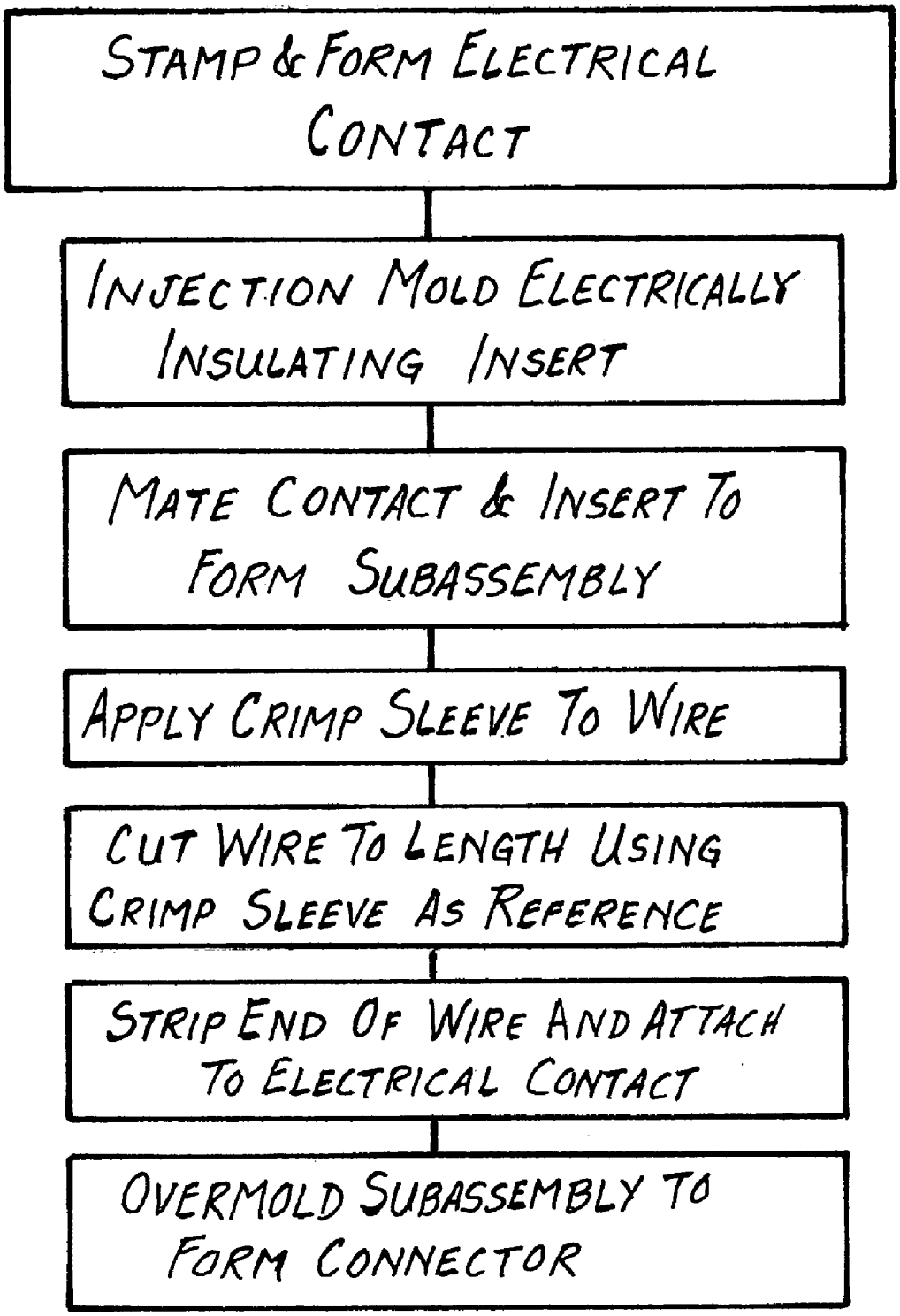
FIG. 1 is a flow diagram of the process of the invention.
Figure 2:
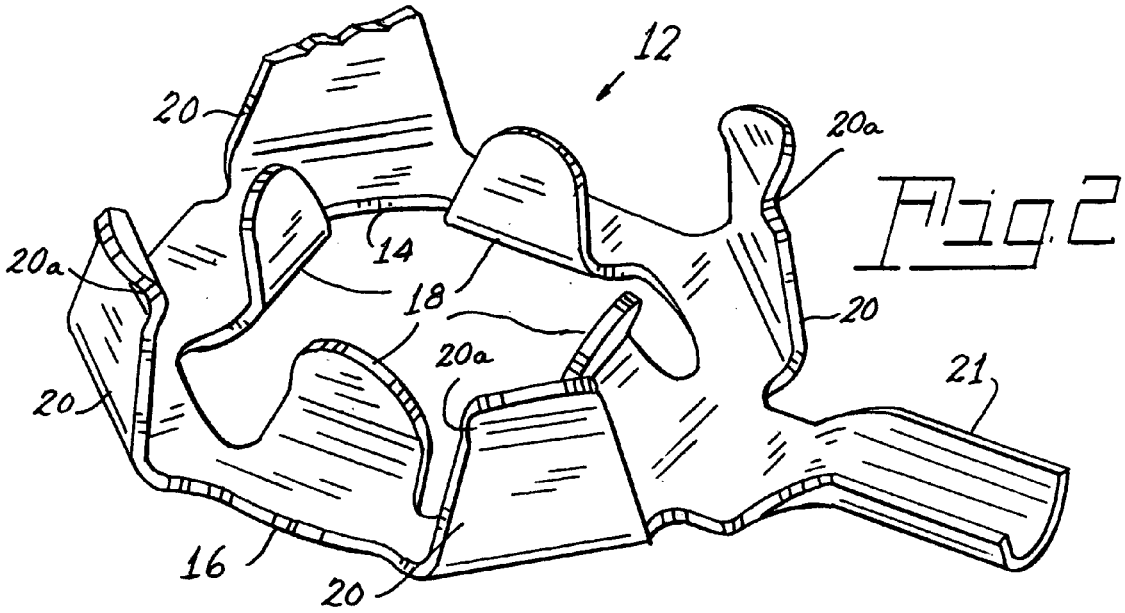
FIG. 2 is a perspective view of an electrical contact used with the invention.

Referring now to the drawings with greater particularity, there is shown in FIG. 2 a substantially annular electrical contact 12 having an inside area 14 and an outside area 16. A preferred material for the contact 12 is phosphorus-bronze and the contact is preferably formed by stamping. The inside area 14 is provided with a plurality of contact beams 18. In the particular embodiment shown there are four such contact beams. The outside area 16 is provided with a plurality of retention beams 20. In this particular embodiment there are four such retention beams. The contact beams and the retention beams are spaced alternately from one another. A wire-receiving trough 21 is provided between two of the retention, beams and extends away from the annulus.

Figure 3:
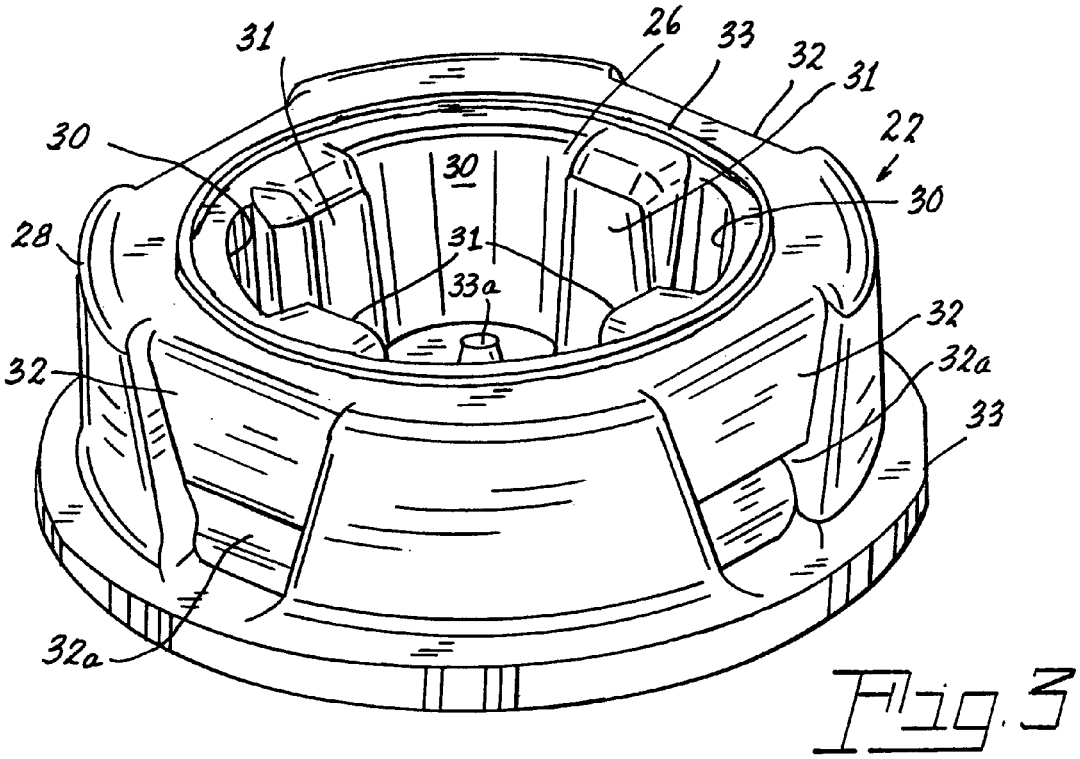
FIG. 3 is a perspective view of an insert used with the invention.

A substantially cup-shaped electrically insulating insert 22 (see FIG. 3) is also provided and comprises an interior wall 26 and an exterior wall 28. A preferred material for the insert is polypropylene. The interior wall 26 is provided with pockets 30 for receiving the contact beams 18 and the exterior wall 28 is provided with pockets 32 for receiving the retention beams 20. One end of the pockets 32 is provided with an undercut 32*a* to receive a reentrant portion 20*a* formed on the retention beams 20. A crush rib 33 is provided on the top surface of the insert 22 and is used to ensure a seal between the contact 12 and the insert 22. The rib 33 also absorbs tolerances between the parts. A post 33*a* can be provided in the bottom of the insert 22 to provide an identification feature indicating that the contact beams 18 have been set properly. The contact beam position set tooling will mushroom the post 33*a* during the beam setting process.

The space between the pockets 30 includes nibs 31, which limit the deflection of the contact beams 18, as will be explained further hereinafter.

Figure 4:
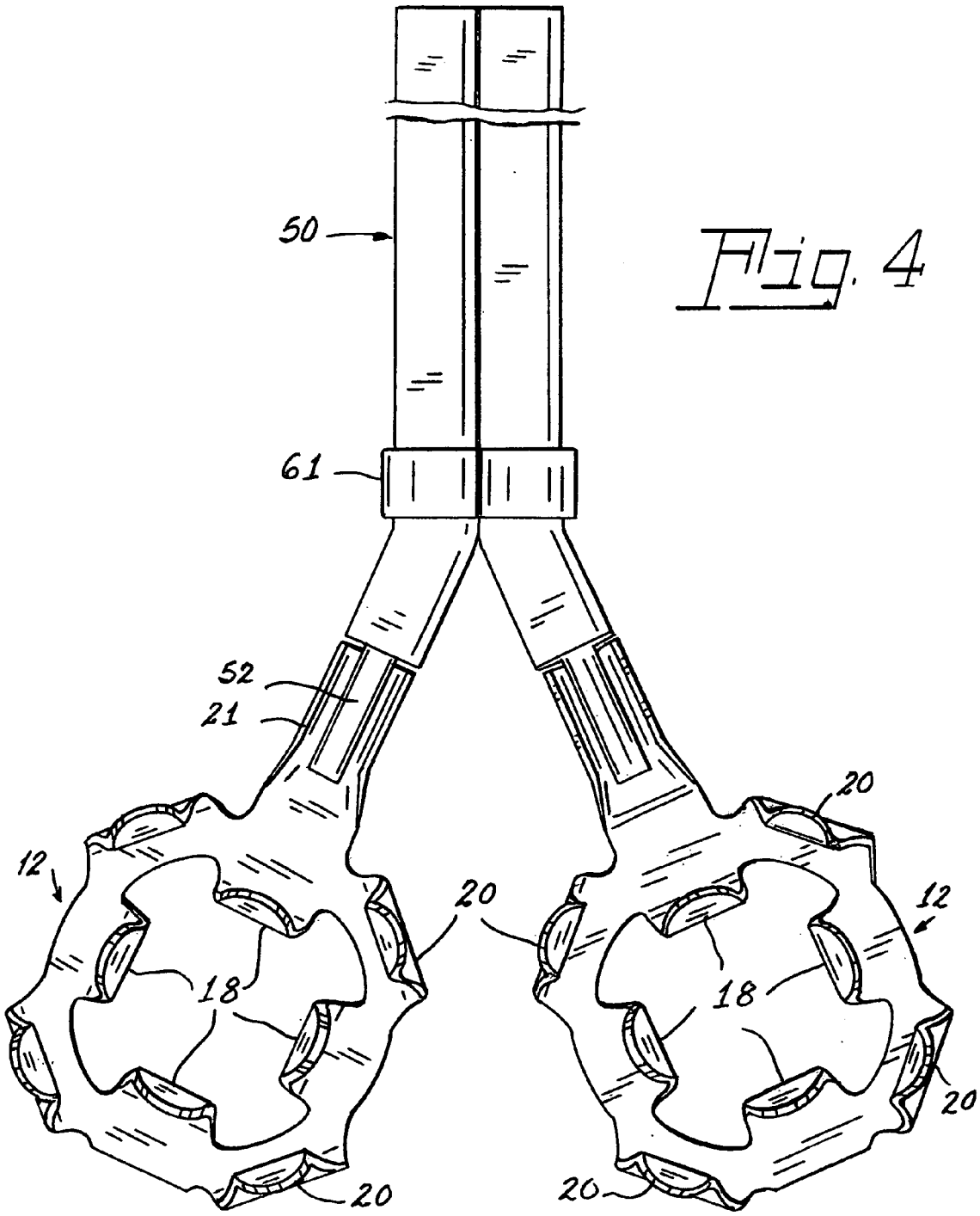
FIG. 4 is a plan view of two electrical contacts attached to a suitable wire.

In a preferred embodiment of the invention two of the annular electrical contacts 12 are attached to a suitable wire 50 as is shown in FIG. 4. A crimp sleeve 61 is attached to the wire and serves as a guide for the cutting and stripping of the wire. The stripped ends 52 of the wire are attached to the wire-receiving trough 21 by solder. This trough 21 is located at the outer extremity of the contact to avoid damaging the inserts due to the heat of the solder. The Y shape allows the mating areas to be flexible; therefore, they are able to absorb tolerance differences of connector centerline distance.

Figure 5:
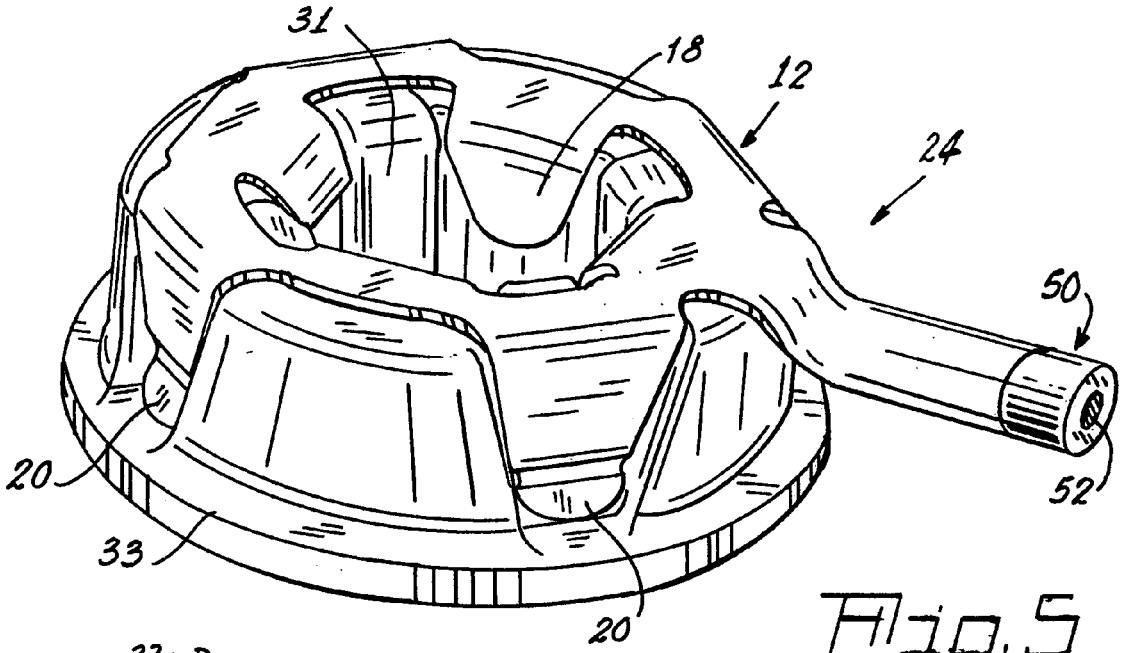
FIG. 5 is a perspective view of an electrical contact-insulating insert sub-assembly.

Referring now to FIG. 5, there is shown a subassembly 24 comprised of a mated electrical contact 12 and an electrically insulating insert 22. The contact beams 18 are fitted into the pockets 30 and the retention beams 20 are accommodated within the pockets 32 with the reentrant portions 20*a* engaged with the undercuts 32*a* for a secure attachment.

The subassemblies 24, if two are present, are then placed in a mold and overmolded with a suitable electrically insulating material, such as a thermoplastic elastomer, to produce a body 34 completely covering the external wall 28 of the insert 22 and forming the electrical connector 10. To aid in retention of the subassembly 24 within the body 34 the insert 22 is provided with a flange 33, which is encompassed within the overmold.

Figure 6:
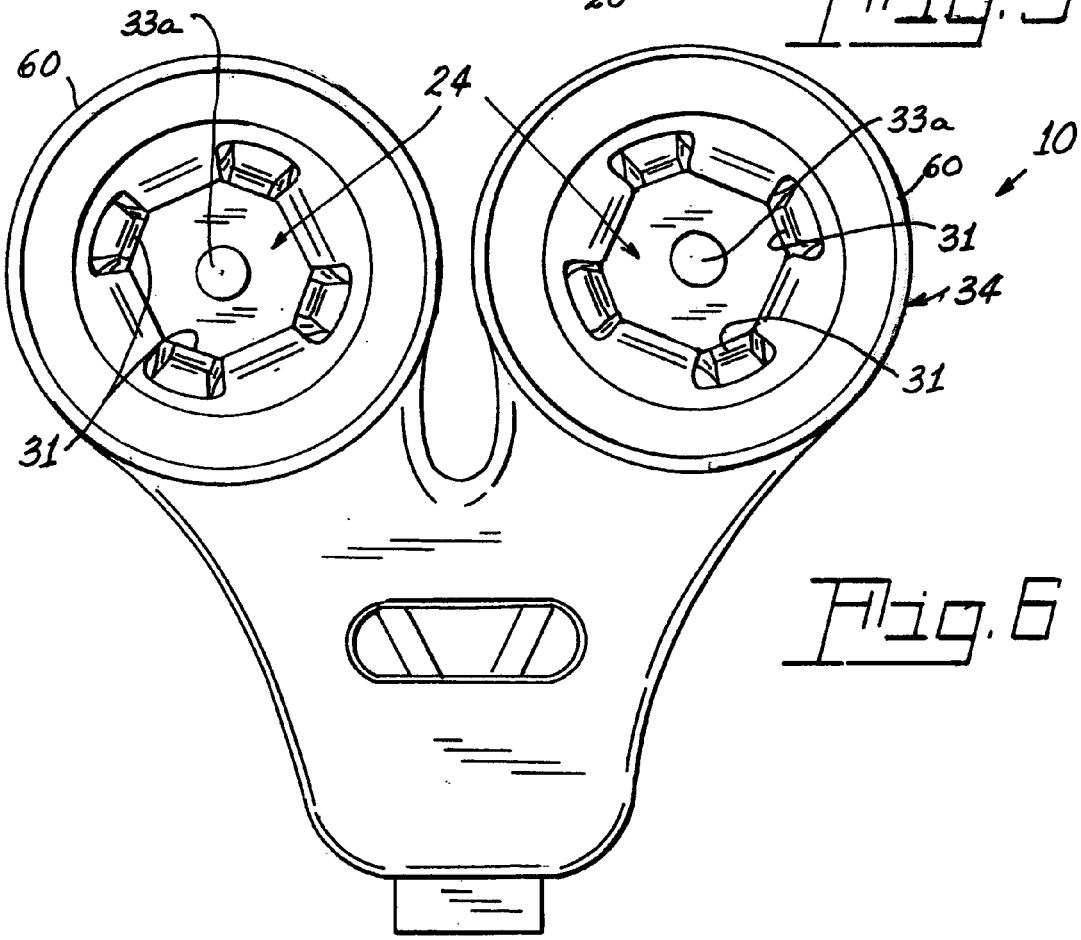
FIG. 6 is a plan view of the obverse side of an electrical connector in accordance with an aspect of the invention.
Figure 7:
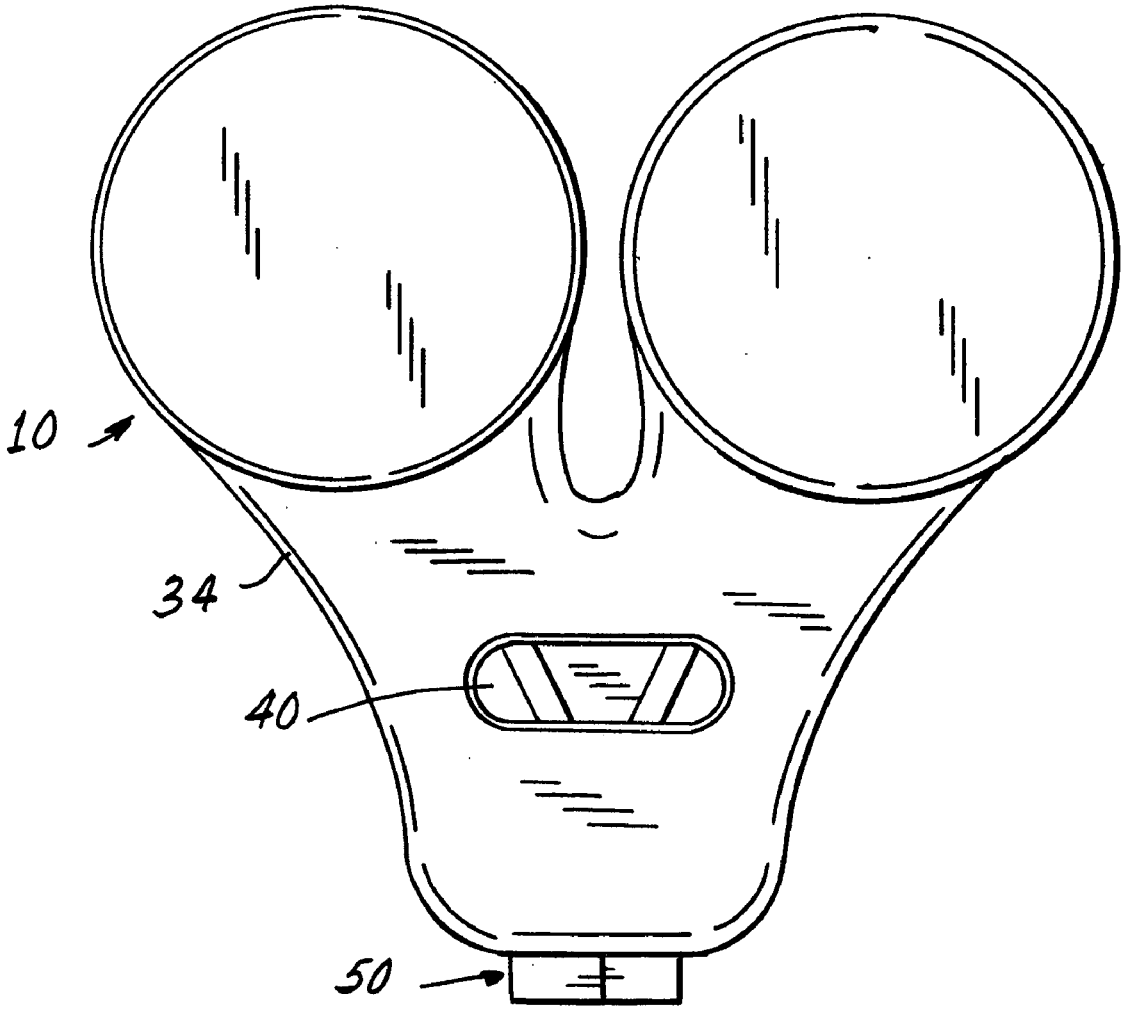
FIG. 7 is a plan view of the reverse side of the electrical connector of FIG. 6.

The obverse of the electrical connector 10 is shown in FIG. 6 and the reverse is shown in FIG. 7. If desired a wire-float prevention feature can be provided within the mold leaving a depression 40 in the body 34. This feature reduces the concern over the wires floating to the surface during the overmolding.

Figure 8:
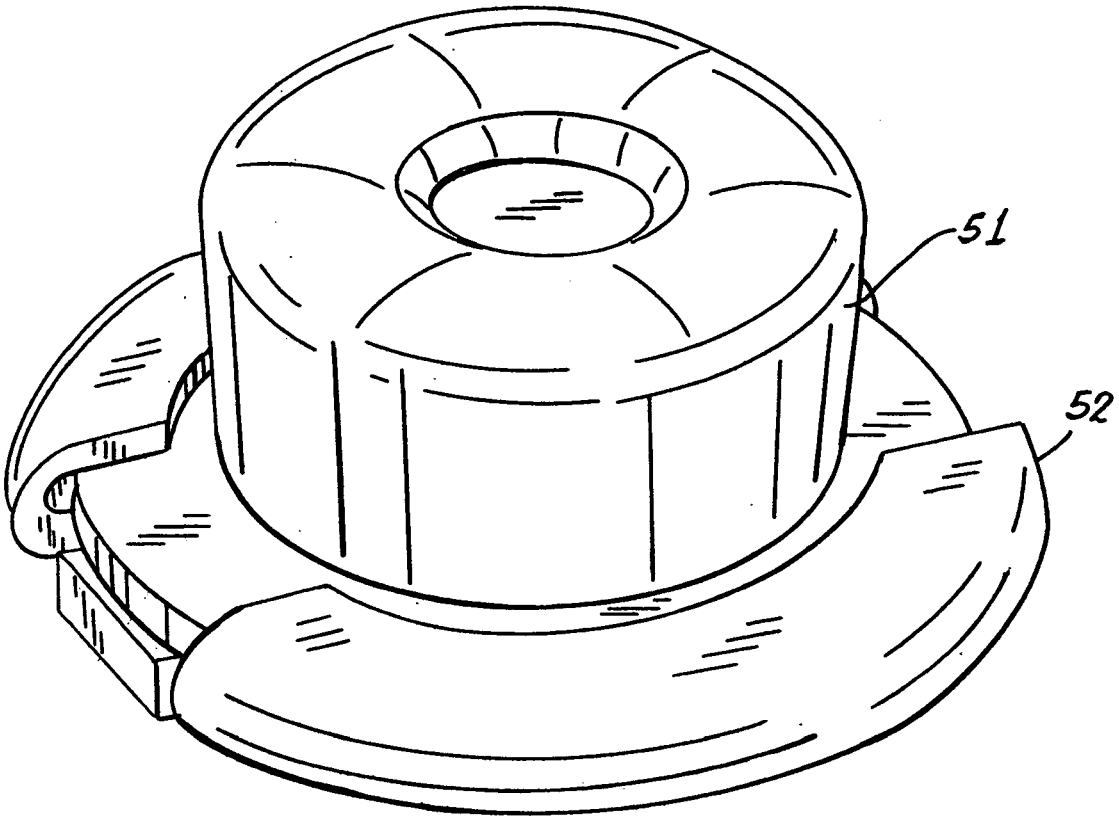
FIG. 8 is a perspective view of a male contact with which the connector of the invention can be employed.

The mating male electrical contact 51 is shown in FIG. 8 and generally comprises a brass button of cylindrical configuration. For the particular electrical connector 10 with which this invention is concerned the contact 51 would be affixed to the glass base by means of the base 53.

The body 34 is shown with a glass-contact rib 60 that is provided by the overmold and that is sized to rest on the glass when the connector 10 is mated to the button 50. This prevents foreign material from entering the contact area and also prevents the contact from rattling.

Referring now particularly to FIG. 6 the advantage of the ribs 31 can be seen. When mated with a contact 51 the contact beams 18 engage the contact and are slightly depressed; however, the ribs 31 also engage the sides of the contact 51 and prevent the contact beams 18 from being overstressed.

There is thus provided an electrical connector with superior advantages over the prior art. It is rugged and serves to provide good electrical connection where needed in a reliable manner.

While there have been shown and described what are at present considered to be the preferred embodiments of the invention, it will be apparent to those skilled in the art that various changes and modification can be made herein without departing from the scope of the invention as defined by the appended claims.

What is claimed is:

1. An electrical connector comprising:

a substantially annular electrical contact with an inside dimension and an outside dimension, said inside dimension being provided with a plurality of contact beams depending therefrom and said outside dimension being provided with a plurality of retention beams depending therefrom, said plurality of contact beams and said plurality of retention beams being spaced alternately from one another;

a substantially cup-shaped electrically insulating insert mated with said annular electrical contact to form a subassembly, said substantially cup-shaped insulator having an interior wall and an exterior wall, said interior wall including a plurality of pockets for receiving said contact beams and said exterior wall including a plurality of pockets for receiving said retention beams, said contact beams and said retention beams engaging their respective pockets; and an electrically insulating overmold forming a body about said subassembly, said body completely covering said exterior wall of said cup-shaped electrically insulating insert.

2. The electrical connector of claim 1 wherein said connector is Y-shaped and includes two subassemblies within said body.

* * * * *